US006582277B2

(12) United States Patent
Korovin

(10) Patent No.: US 6,582,277 B2
(45) Date of Patent: Jun. 24, 2003

(54) METHOD FOR CONTROLLING A PROCESS IN A MULTI-ZONAL APPARATUS

(75) Inventor: Nikolay N. Korovin, Phoenix, AZ (US)

(73) Assignee: SpeedFam-IPEC Corporation, Chandler, AZ (US)

( * ) Notice: Subject to any disclaimer, the term of this patent is extended or adjusted under 35 U.S.C. 154(b) by 88 days.

(21) Appl. No.: 09/846,965

(22) Filed: May 1, 2001

(65) Prior Publication Data

US 2002/0164924 A1 Nov. 7, 2002

(51) Int. Cl.[7] ..... B24B 49/00

(52) U.S. Cl. ..... 451/5; 451/8; 451/41; 451/285; 451/286; 451/287; 451/288; 451/289; 451/358; 451/398

(58) Field of Search ..... 451/5, 8, 41, 285, 451/286, 287, 288, 289, 398, 388

(56) References Cited

U.S. PATENT DOCUMENTS

| | | | |
|---|---|---|---|
| 5,205,082 A | 4/1993 | Shendon et al. | |
| 5,230,184 A | 7/1993 | Bukhman | |
| 5,584,746 A | 12/1996 | Tanaka et al. | |
| 5,584,751 A | 12/1996 | Kobayashi et al. | |
| 5,605,488 A | 2/1997 | Ohashi et al. | |
| 5,624,299 A | 4/1997 | Shendon | |
| 5,660,517 A | 8/1997 | Thompson et al. | |
| 5,681,215 A | 10/1997 | Sherwood et al. | |
| 5,738,574 A | 4/1998 | Tolles et al. | |
| 5,762,539 A | 6/1998 | Nakashiba et al. | |
| 5,762,544 A | 6/1998 | Zuniga et al. | |
| 5,762,546 A | 6/1998 | James et al. | |
| 5,795,215 A | 8/1998 | Guthrie et al. | |
| 5,820,448 A | 10/1998 | Shamouilian et al. | |
| 5,916,016 A | 6/1999 | Bothra | |
| 5,964,653 A | 10/1999 | Perlov et al. | |
| 6,093,089 A | 7/2000 | Chen et al. | |
| 6,309,290 B1 * | 10/2001 | Wang et al. | 451/398 |

FOREIGN PATENT DOCUMENTS

| | | |
|---|---|---|
| EP | 0 786 310 A1 | 7/1997 |
| EP | 0 790 100 A1 | 8/1997 |
| EP | 0 791 431 A1 | 8/1997 |
| EP | 0 841 123 A1 | 5/1998 |
| WO | WO 99/07516 | 2/1999 |

* cited by examiner

*Primary Examiner*—Joseph J. Hail, III
*Assistant Examiner*—Shantese McDonald
(74) *Attorney, Agent, or Firm*—James L. Farmer

(57) ABSTRACT

A method for controlling a process in a multi-zonal processing apparatus and specifically for determining the optimum values to set for processing parameters $J(Z_i)$ in each of the zones of that apparatus includes processing a test work piece in the apparatus with initial values $J_i(Z_i)$ of the parameters in each zone i to achieve a process result $Q_i(x)$. Then a process result $Q_j(x)$ to be expected from incremental changes in the parameters to values $J_j(x)$ is calculated. The expected process results $Q_j(x)$ are related to the initial process results $Q_i(x)$ by the relationship:

$$Q_j(x)=Q_i(x)*J_j(x)/J_i(x).$$

After determining optimum values of $J(Z_i)$ to reduce the difference between the expected process result and a target process result, a work piece is processed through the process apparatus using those optimum values of $J(Z_i)$.

23 Claims, 3 Drawing Sheets

METHOD FOR CONTROLLING A PROCESS IN A MULTI-ZONAL APPARATUS

FIELD OF THE INVENTION

This invention relates generally to a method for controlling a process and more particularly to a method for controlling a process, such as a chemical mechanical planarizaion process, in a multi-zonal processing apparatus.

BACKGROUND OF THE INVENTION

Many types of processing apparatus include a plurality of zones within each of which some processing variable can be controlled in order to achieve some desired process result when a work piece is processed in the apparatus. For example, the processing apparatus may permit a variable or parameter such as pressure, temperature, voltage, current, or the like to be separately set in each of the plurality of zones to achieve a predetermined parameter distribution profile across the work piece. The predetermined profile, in turn, is intended to achieve a repeatable and predetermined result across the surface of the processed work piece. The process being controlled may be, for example, a polishing process, a planarization process such as a chemical mechanical planarization (CMP) process, a deposition process, or any other process practiced in an apparatus having a plurality of zones in which a process parameter can be adjusted in the various zones of the apparatus.

The multi-zonal processing apparatus and the process to be practiced in that apparatus, however, may suffer from the fact that there are a limited number of discrete zones within which the process parameter can be controlled. The limited number of discrete zones may cause the resulting parameter distribution profile to be discontinuous and segmented instead of the desired predetermined profile. In addition, discontinuities at the boundaries between zones may cause the profile to deviate even more from the ideal predetermined profile. Cross effects between adjacent zones and nonuniformities within zones may also complicate the resulting profile and hence the resulting process. Existing multi-zonal processing apparatus require extensive and multiple experimentation with intuitive dialing to properly set the parameters in each of the plurality of zones to achieve a desired result. Changes in the preprocessing condition of work pieces may require additional experimentation to adjust the parameters to the changed work pieces. Such required experimentation to properly set the apparatus is inconsistent with the efficient, reliable, and repeatable processing of work pieces.

Accordingly, a need exists for a method to automatically determine the optimum setting of parameters in the zones of a multi-zonal processing apparatus to repeatably and reliably achieve a parameter distribution profile that is a close approximation to a predetermined target parameter distribution profile.

BRIEF DESCRIPTION OF THE DRAWINGS

The present invention will be fully understood upon consideration of the following detailed description of the invention taken together with the drawing figures in which FIGS. 1 and 2 schematically illustrate, in cross sectional side view and bottom view, respectively, a portion of a multi-zonal processing apparatus within which the inventive method may be practiced.

DETAILED DESCRIPTION OF THE INVENTION

This invention relates generally to a method for controlling a process, and especially to a method for controlling a planarization process such as a chemical mechanical planarization (CMP) process. For purposes of illustration only, the invention will be described as it applies to a CMP process and specifically as it applies to the CMP processing of a semiconductor wafer. It is not intended, however, that the invention be limited to these illustrative embodiments; in fact, the invention is applicable to many processes and to the processing of many types of work pieces.

In the CMP process a work piece, held by a work piece carrier head, is pressed against a moving polishing pad in the presence of a polishing slurry. The mechanical abrasion of the material on the work piece surface combined with the chemical interaction of the slurry with that material removes a portion of the material from the surface and produces a surface having a predetermined profile, usually a planar surface. The average removal rate of material from the surface, RR, is given by the so called Preston's equation:

$$RR=k*P*V$$

where k is a coefficient depending on the slurry used, the distribution of the slurry, and a number of other factors, V is the relative velocity between the surface of the work piece and the polishing pad, P is the polishing pressure, and * is the multiplication function. The equation can be modified to give the removal rate RR(x) at any location x on the work piece surface:

$$RR(x)=k(x)*P(x)*V(x)$$

where k(x), V(x) and P(x) are the polishing coefficient, relative velocity, and polishing pressure, respectively, as a function of position on the work piece surface. In the conventional CMP apparatus the motion of the polishing pad and/or the work piece, the slurry distribution and other factors are carefully controlled so that k(x) and V(x) are substantially constant across the surface of the work piece. In one type of CMP apparatus, for example, the relative velocity is held substantially the same at all locations on the surface by moving the polishing pad in a controlled orbital motion while the work piece is rotated about an axis perpendicular to the surface to be polished. With k(x) and V(x) substantially constant, the localized removal rate is proportional to the localized polishing pressure and a desired removal rate profile, RR(x), is thus achieved by establishing a predetermined localized pressure profile, P(x).

Figure 1:
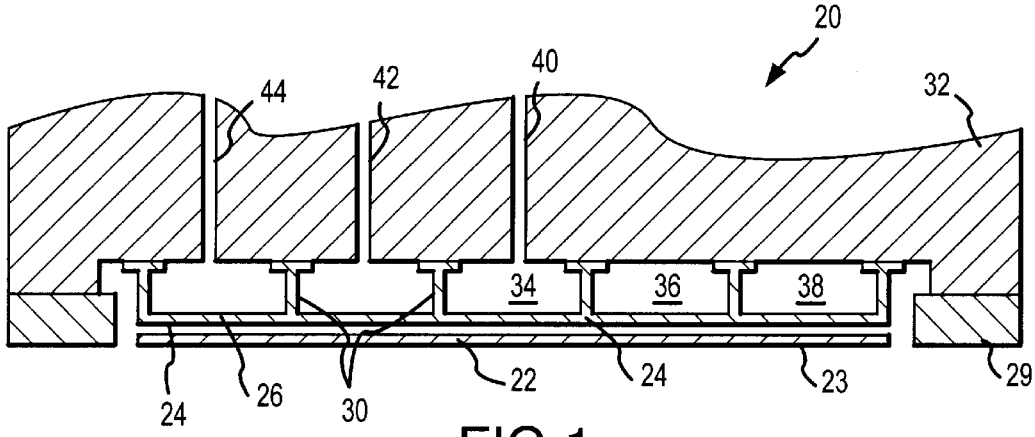
Figure 2:
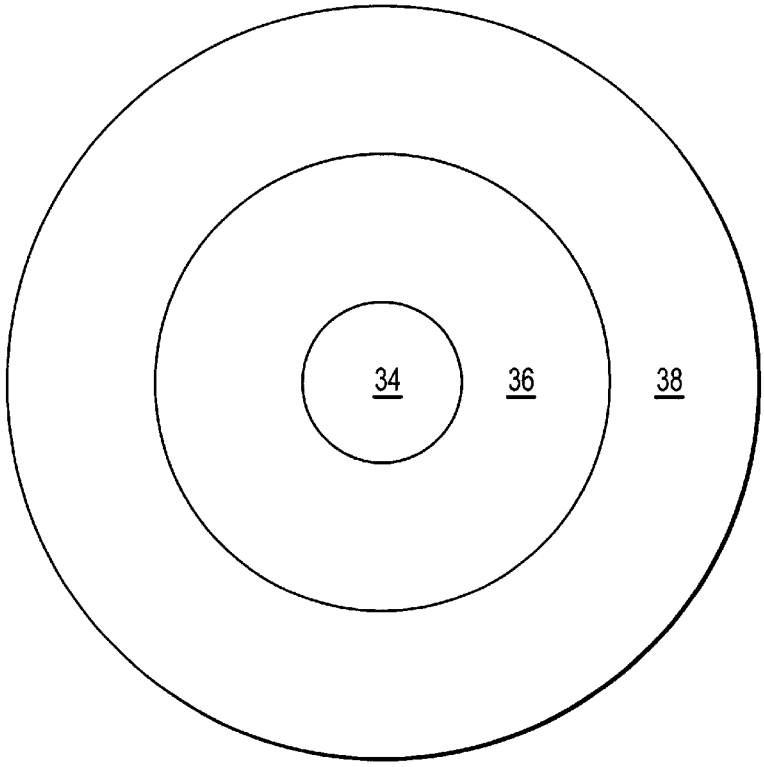

FIGS. 1 and 2 schematically illustrate, in cross sectional side view and bottom view, respectively, a multi-zonal work piece carrier 20 that is designed to provide the ability to control the localized pressure profile during the CMP processing of a work piece 22. The carrier includes a diaphragm 24 formed of a semi-rigid elastomeric material and having a substantially planar sheet 26 with a bottom surface 28. If the work piece is a semiconductor wafer having a diameter of 200 millimeters (mm), the bottom surface would also have a diameter of about 200 mm. A wear ring 29 surrounds the diaphragm and the work piece and serves, among other functions, to confine the work piece under the carrier during planarization. During the CMP operation the bottom surface of the diaphragm presses against the upper surface of work piece 22 and causes lower surface 23 of the work piece to be pressed against a polishing pad (not shown). A plurality of ribs 30 extend upwardly from sheet 26 to rigid carrier head 32. The substantially planar sheet 26, ribs 30, and rigid carrier head 32 form a plurality of zones 34, 36, and 38 within which the pressure can be controlled. Three zones are illustrated, but more or fewer zones could also be implemented. In the illustrated embodiment central zone 34 is surrounded by concentric zones 36 and 38. The pressure in zone 34 can be controlled by a pressure regulator (not illustrated) that is connected to the zone through an orifice 40. In a similar manner, the pressure in zones 36 and 38 can be controlled by pressure regulators (not illustrated) coupled to the respective zones through orifices 42 and 44. By controlling pressure in the individual zones, the localized pressure exerted on work piece 22 is controlled.

Figure 3:
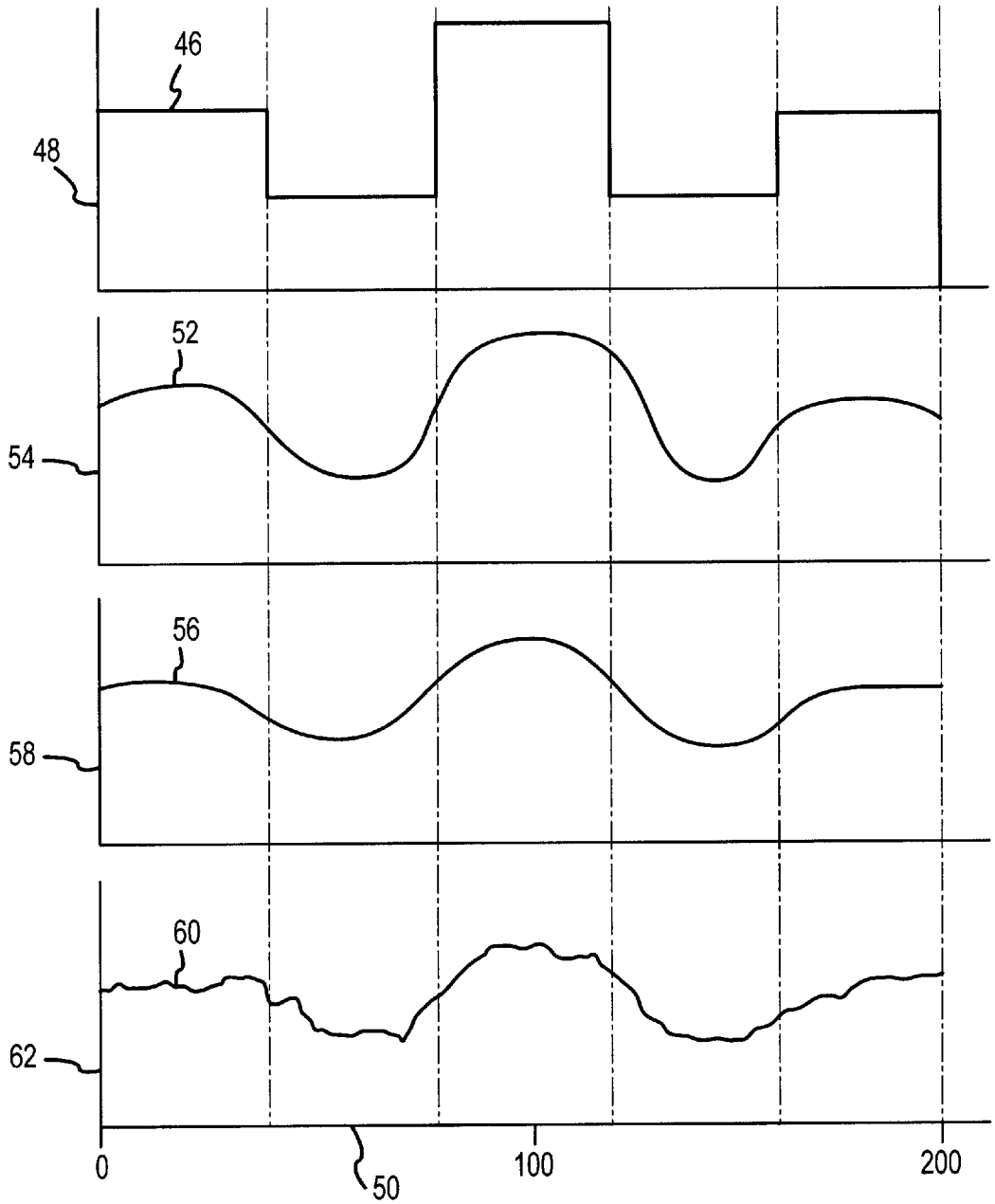
FIG. 3 illustrates, in graphical form, an example of the pressure distribution in the three zones of a multi-zonal processing apparatus, the resulting pressure distributions on the upper and lower surfaces of a work piece, and the resulting removal rate of material from the lower surface of the work piece.

FIG. 3 illustrates, in graphical form, one example of the pressure distribution in the three zones of work piece carrier 20, the resulting pressure distribution on the upper surface of work piece 22, the resulting pressure distribution on the lower surface 23 of the work piece, and the resulting removal rate of material from the lower surface of the work piece. Curve 46 illustrates the pressure $P(Z_i)$ in each of the zones where i is the zone number. The vertical axis 48 indicates pressure in pounds per square inch (psi), and horizontal axis 50 indicates position across the diaphragm in mm. As an illustrative example, the pressure in zone 34 can be 3 psi the pressure in zone 36 can be 1 psi, and the pressure in zone 38 can be 2 psi. Curve 52 illustrates the pressure distribution measured at the upper surface of the work piece as a result of the pressures set in zones 34, 36, and 38. Vertical axis 54 again indicates pressure in psi. Because of edge effects and cross talk at the edges of the zones and nonuniformities in the diaphragm, there is a smearing and alteration of the pressure distribution so that the pressures measured in the zones $Z_i$ are not the same as those measured on the upper surface of the work piece. Curve 56 illustrates the pressure distribution that would be measured on lower surface 23 of work piece 22. Again, vertical axis 58 indicates pressure in psi. A further smearing of the pressure distribution is observed as a result of the generally rigid nature of the work piece. The relationship between the pressures set in zones 34, 36, and 38 and as illustrated by curve 46 and the pressures actually present at the lower surface of the work piece, the surface to be planarized, as illustrated by curve 56, represents an analytical model of the processing apparatus. That is, the localized pressure profile $P_z(x)$ is a function of the pressure $P(Z_i)$ established in each of the zones i. Curve 60 illustrates the removal rate of material from surface 23 of work piece 22 as a result of the CMP process with the pressures set in zones 34, 36, and 38 as illustrated by curve 46. Vertical axis 62 corresponding to curve 60 indicates normalized removal rate of material where the localized removal rate is normalized to the mean removal rate.

In accordance with one embodiment of the invention, because the localized removal rate is proportional to the localized polishing pressure, a revised localized removal rate can be determined in accordance with:

$$RR_{new}(X)=RR_{old}(X)*P_{new}(x)/P_{old}(x)$$

where $RR_{new}(x)$ and $RR_{old}(X)$ are the new and old localized removal rates, respectively, and $P_{new}(X)$ and $P_{old}(x)$ are the new and old localized polishing pressure profiles, respectively.

As noted above, the analytical model of the processing apparatus (in the illustrative embodiment a CMP apparatus) relates the pressures set in the plurality of zones of the multi-zonal apparatus to the pressure distribution profile actually applied on the surface of the work piece to be processed. In similar manner the analytical model of other types of multi-zonal processing apparatus relates a processing parameter J set in the plurality of zones to the parameter distribution profile J(x) on the surface of the work piece being processed. In accordance with one embodiment of the invention a process conducted in a multi-zonal processing apparatus in which a process parameter $J(Z_i)$ can be controlled to establish a process parameter distribution J(x) in accordance with the analytical model for the apparatus is controlled in the following manner. A test work piece is first processed using initial settings $J_I(Z_i)$ of a processing parameter J in each of the plurality of zones i to establish a process parameter distribution $J_I(x)$ and to achieve a measurable process result $Q_I(x)$ on the work piece. The processing parameter J is then modified in at least one of the zones to establish a modified process parameter distribution $J_f(x)$ and to achieve a revised target processing result $Q_f(x)$ where the target processing result and the modified process parameter distribution are related by:

$$Q_f(x)=Q_I(x)*J_f(x)/J_I(x).$$

A work piece is then processed with the process parameter J set in each of the zones to achieve the process parameter distribution $J_f(x)$.

In accordance with a further embodiment of the invention a planarization process, such as a CMP process, conducted in a multi-zonal process apparatus can be controlled in the following manner. For purposes of illustration only, but without limitation, consider the chemical mechanical planarization of a semiconductor wafer in a CMP apparatus having three zones in each of which the polishing pressure can be adjusted, such as in the CMP apparatus illustrated in FIGS. 1 and 2. In such an apparatus the localized removal rate of material from the surface of a work piece is proportional to the localized pressure with which the semiconductor wafer is pressed against a polishing pad. As a first step in the control method the surface profile of the wafer to be planarized is measured. The surface profile can be measured, for example, at a plurality of points evenly spaced along a diameter of the wafer. Depending on the material on the surface of the wafer, the measurement can be made optically, electrically, or by mechanical means. The measured surface profile is compared to the desired surface profile to determine the amount of material that must be removed from the wafer surface as a function of position x on the wafer surface and to determine a desired or target localized removal rate profile, $RR_t(x)$. The amount of material to be removed is the difference between the measured incoming profile and the desired after processing surface profile. The desired after processing surface profile may be a substantially planar surface, but also can be any other surface profile. In accordance with this embodiment of the invention, a first wafer is then processed in the CMP apparatus as a test wafer using an initial pressure setting $P_1(Z_I)$, $P_1(Z_2)$, and $P_1(Z_3)$ in each of the three zones. The surface of the test wafer is again measured after processing and the resultant localized removal rate, $RR_1(x)$, is determined. The resultant test removal rate profile $RR_1(X)$ is the removal rate profile achieved with the pressures in the three zones set to $P_1(Z_i)$. Next the difference between the target removal rate profile and the test removal rate profile is calculated. Preferably the difference is calculated by calculating the standard deviation, but other metrics can also be used. In a preferred embodiment of the invention the following steps are then followed to determine pressure settings for each of the three zones of the processing apparatus that will achieve an optimum result. The optimum result is a removal rate profile that is as close to the target removal rate as can be achieved with the processing apparatus. Starting from the pressure settings $P_1(Z_i)$, the removal rate profile expected for a change in the pressure in at least one of the three zones from the pressure $P_1(Z_l)$ to a new pressure $P_2(Z_i)$ is calculated using the relationship:

$$RR_2(x)=RR_1(x)*P_2(X)/P_1(x),$$

or in general, the relationship:

$$RR_{n+1}(x)=RR_n(x)*P_{n+1}(x)/P_n(x)$$

where n+1 denotes the state to be calculated and n denotes the most recent state for which a calculation has been made. After each such calculated change in removal rate profile, the new removal rate profile is compared to the target removal rate profile to determine whether or not the change in pressure would cause the new removal rate profile to approach the desired target removal rate profile. Preferably the effect of changes in the zonal pressures is systematically explored until no change in the pressure in any of the zones further reduces the difference between the calculated expected removal rate profile and the target removal rate profile. In a preferred embodiment, after determining the removal rate profile $RR_1(x)$ corresponding to the initial pressure settings $P_1(Z_i)$, the removal rate profile, $RR_2(x)$, that would result from a small change in the pressure in zone 1, such as an increase in the pressure in that zone by 1% ($P_2(Z_l)=(1.01)P_1(Z_l)$), is calculated using the above equation. The standard deviation between that newly calculated removal rate profile, $RR_2(x)$, and the target removal rate profile, $RR_t(x)$, is calculated. If that standard deviation is less than the standard deviation between $RR_1(x)$ and $RR_t(x)$, the new pressure, $P_2(Z_l)$, in zone 1 is retained. If the standard deviation increases, a new removal rate profile is calculated that corresponds to a small change in pressure in zone 1 in the opposite direction, such as a decrease in the pressure in that zone by 1% ($P_3(Z_l)=(0.99)P_1(Z_l)$). Again, the standard deviation between the newly calculated removal rate profile and the target removal rate profile is calculated. If that standard deviation is less than the standard deviation between $RR_1(x)$ and $RR_t(x)$, the new pressure, $P_3(Z_l)$, in zone 1 is retained. If the standard deviation increases, the initial pressure in that zone, $P_1(Z_l)$, is retained. These steps are repeated for each zone of the apparatus. In this manner, the result of small changes in pressure, either increases or decreases, on the calculated removal rate profile are investigated. Pressure changes that result in a decrease in the standard deviation between the calculated removal rate profile and the target removal rate profile are retained. After the result of small pressure changes are investigated for each zone, the process is repeated for each zone using the retained pressures as the starting pressure in each zone. This investigation is continued until no further decreases in the standard deviation are observed. The values of pressure in each zone that result in the minimum standard deviation are then used as the operating pressures to process the next wafer through the CMP process.

Semiconductor wafers, like many work pieces, are often processed in batches or lots. A lot may contain, for example, a number of similar work pieces. Each work piece in a lot can be processed in the manner just described. The initial surface profile of each work piece is measured and a target removal rate profile, $RR_t(x)$, is determined for that work piece. The proper settings for each of the zones are determined by iteratively calculating removal rate profiles that would result from iterative changes in the process parameter in each of the plurality of zones in the processing apparatus. The process parameters chosen for each zone to process the work piece are those parameters that achieve the minimum difference between the removal rate profile for those parameters and the target removal rate profile. In accordance with a further embodiment of the invention, as each work piece is processed, that work piece can be measured and used as the test work piece for determining the proper values of the process parameter to set in each of the plurality of zones for processing the next work piece. In accordance with this embodiment of the invention, information about the incoming surface profile and the desired after processing profile together determine the target removal rate profile, $RR_t(x)$. The after processing profile of the previous work piece provide information about the actual, achieved removal rate profile and is used as the initial removal rate profile, $RR_i(x)$, for the next work piece. In this manner the inventive algorithm will compensate for potential drift in the process, including, for example, changes in slurry properties, pressure transducer properties, and the like, as well as drift in material properties such as the hardness of the material being removed.

Figure 4:
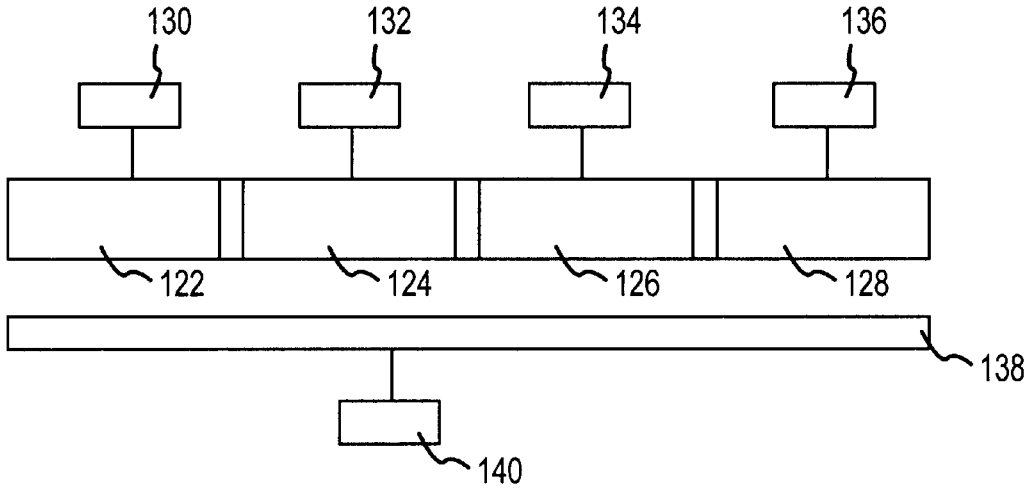
FIG. 4 illustrates schematically a portion of a multi-zonal deposition apparatus within which the inventive method may be practiced.

FIG. 4 illustrates schematically a multi-zonal deposition apparatus 120 in which, for example, copper or other metals can be electrodeposited. Deposition apparatus 120 includes a plurality of deposition cathodes 122, 124, 126, and 128 coupled to power supplies 130, 132, 134, and 136, respectively. A work piece 138 upon which the copper or other metal is to be deposited is coupled to an additional power supply 140 or to electrical ground. Deposition of metal onto work piece 138 can be controlled in accordance with one embodiment of the invention. The ability to control the voltage, $V(Z_i)$, applied to the plurality of cathodes by the plurality of power supplies allows the deposition current profile, I(x), to be controlled as a function of position x along the surface of the work piece. By properly controlling the deposition current profile, a process result such as, for example, a deposition thickness profile, T(x), can be controlled as a function of position on the work piece surface.

First a target deposition thickness profile, $T_t(x)$, is determined. This is the thickness of deposited metal desired on the work piece as a function of position on the work piece surface. The application of a voltage, $V(Z_i)$, on each of the plurality of cathodes results in a current profile I(x) on the surface of the work piece. Deposition thickness is directly proportional to the applied deposition current, so the current profile, I(x), can be directly implied from a measurement of thickness of the deposited layer on the work piece surface. Determining I(x) for a given $V(Z_i)$ determines the analytical model for the processing apparatus. A test work piece can be processed in the apparatus with a first voltage, $V_1(Z_i)$, set for the voltage on each of the i cathodes. The deposition thickness profile, $T_1(x)$, is measured on the test work piece and is compared to the target deposition thickness profile, for example by calculating the standard deviation between the two thicknesses. The target deposition thickness, $T_f(x)$, that would result from a modified in the voltage in at least one of the zones to establish a modified voltage profile, $I_f(x)$, is then calculated where the target thickness and the test processing thickness are related by:

$$T_f(x)=T_1(x)*I_f(x)/I_1(x).$$

As above, the optimum values for $I_f(Z_i)$ can be found by iteration, comparing the calculated deposition thickness resulting from each iteration of the zonal voltages, $V_{n+1}(Z_i)$, to the previous value of zonal voltages, $V_n(Z_i)$. This same method, in accordance with the invention, can be applied to the control of any process carried out in a multi-zonal apparatus in which a process parameter can be adjusted in each of the plurality of zones in the apparatus.

Thus it is apparent that there has been provided, in accordance with the invention, a method for controlling a process in a multi-zonal processing apparatus. Although the invention has been described and illustrated with reference to various preferred embodiments thereof, it is not intended that the invention be limited to those illustrative embodiments. For example, the invention can be applied to the control of other multi-zonal processes and to the processing of other work pieces. Those of skill in the art will recognize that many variations and modifications of the illustrative embodiments are possible without departing from the broad scope of the invention. Accordingly, it is intended to encompass within the invention all such variations and modifications as fall within the scope of the appended claims.

What is claimed is:

1. A method for controlling planarization of a work piece by a processing apparatus comprising a plurality of zones, the rate of removal of material from the work piece surface by the apparatus being a function of pressure applied to the work piece and the pressure applied to the work piece being controlled by the pressure in each of the plurality of zones, the method comprising the steps of:

processing a test work piece using initial pressures in each of a plurality of zones to establish an initial pressure distribution profile $P_i(x)$ applied as a function of position (x) on a work piece surface and to achieve an initial removal rate $RR_i(x)$ as a function of position (x) on the work piece surface;

calculating a removal rate $RR_f(x)$ as a function of position (x) on the work piece surface that would result from modifying the pressure in at least one of the plurality of zones to establish a pressure distribution profile $P_f(x)$ as a function of position (x) on the work piece surface, $RR_f(x)$ calculated in accordance with the relationship:

$$RR_f(x)=RR_i(x)*P_f(x)/P_i(x); \text{ and}$$

planarizing a first work piece using the processing apparatus with pressure in the plurality of zones set to achieve the pressure distribution profile $P_t(x)$.

2. The method of claim 1 wherein the step of planarizing a work piece comprises the step of planarizing a work piece by a process of chemical mechanical planarization.

3. The method of claim 1 further comprising the step of measuring a surface profile of a work piece to be planarized to determine a target removal rate profile $RR_t(x)$.

4. The method of claim 3 wherein the step of calculating comprises the steps of:

sequentially calculating a plurality of removal rates $RR_n(x)$ to be obtained by a sequence of pressure changes in the plurality of zones, each of the plurality of removal rates calculated by $RR_n(x)=RR_{n-1}(x)*P_n(x)/P_{n-1}(x)$ where (n) denotes the iteration being calculated with a pressure distribution profile $P_n(x)$ and (n−1) denotes a previous iteration having the least difference between the removal rate for that iteration and $RR_t(x)$; and comparing each $RR_n(x)$ to $RR_t(x)$ and setting the pressure in each zone to achieve the minimum difference between $RR_n(x)$ and $RR_t(x)$.

5. The method of claim 4 wherein the step of comparing comprises the step of calculating the standard deviation between $RR_n(x)$ and $RR_t(x)$.

6. The method of claim 4 wherein the step of sequentially calculating comprises the steps of:

a) calculating a plurality of removal rates $RR_n(x)$ to be obtained by a sequence of small pressure changes in the plurality of zones b) for each $RR_N(x)$ so calculated, calculating the standard deviation between $RR_N(x)$ and $RR_t(x)$ and adopting those pressure changes that result in a decrease in the calculated standard deviation; and c) repeating steps a) and b) for additional small pressure changes in the plurality of zones until the standard deviation calculated reaches a minimum.

7. The method of claim 1 further comprising the step of empirically establishing a relationship between pressure $P(Z_i)$ in each of the plurality of zones $Z_i$ and the pressure distribution profile $P_z(x)$ on the surface of a work piece as a function of the pressure in each of the plurality of zones.

8. The process of claim 1 further comprising the step of repeating the steps of processing, calculating and planarizing for each of a plurality of work pieces and wherein for each of the plurality of work pieces after the first work piece the step of processing a test wafer comprises the step of processing a previous one of the plurality of work pieces.

9. A method for controlling planarization of a work piece in a processing apparatus comprising a plurality of zones and with which removal rate of material from the work piece surface is a function of pressure applied to the work piece and a localized pressure profile P(x) applied to the work piece surface is a function of pressure $P(Z_i)$ in each of the plurality of zones i, the method comprising the steps of:

a) determining an analytical model for the processing apparatus correlating P(x) to $P(Z_i)$;

b) setting a first pressure $P_1(Z_i)$ in each of the zones and determining the resultant localized pressure profile $P_1(x)$ applied to the surface of a work piece;

c) planarizing a test work piece using the pressures profile $P_1(x)$ and determining a test removal rate profile $RR_1(x)$ as a function of position (x) on the test work piece for the pressures profile $P_1(x)$;

d) determining a target removal rate profile $RR_t(x)$ for a work piece to be planarized;

e) calculating a difference $D_1$ between $RR_1(x)$ and $RR_t(x)$;

f) calculating a revised removal rate profile $RR_2(x)$ resulting from a change in pressure to $P_2(Z_i)$ as a result of changing the pressure $P_1(Z_1)$ in zone one in one direction to a pressure $P_2(Z_1)$ where $RR_2(X)=RR_1(x)*P_2(X)/P_1(x)$ and $P_2(X)$ is the localized pressure profile applied to the work piece surface as a result of the pressure $P_2(Z_i)$;

g) calculating a difference $D_2$ between $RR_2(X)$ and $RR_t(x)$;

h) maintaining the pressure $P_2(Z_1)$ if $D_2$ is less than $D_1$;.

i) if $D_2$ is greater than $D_1$, calculating a revised removal rate profile $RR_3(x)$ resulting from a change in pressure to $P_3(Z_i)$ as a result of changing the pressure $P_1(Z_1)$ in a direction opposite to the one direction in zone one to a pressure $P_3(Z_l)$ where $RR_3(x)=RR_1(x)*P_3(x)/P_1(x)$ and $P_3(x)$ is the localized pressure profile applied to the work piece surface as a result of the pressure $P_3(Z_i)$;

j) calculating a difference $D_3$ between $RR_3(x)$ and $RR_t(x)$;

k) maintaining the pressure $P_3(Z_1)$ if $D_3$ is less than $D_l$ and maintaining the pressure $P_1(Z_1)$ if $D_3$ is greater than $D_1$;

l) repeating steps f) through k) for each of the plurality of zones in the processing apparatus where for each iteration $RR_n(x)$ is calculated in accordance with $RR_n(x)=RR_{n-1}(x)*P_n(x)/P_{n-1}(x)$ and $D_n$ is the difference between $RR_n(x)$ and $RR_t(x)$ where(n) denotes the iteration being calculated and (n−1) denotes the previous iteration having the least difference between the removal rate for that iteration and the target removal rate; and m) planarizing a work piece using the pressure values determined in steps f) through l) that result in a minimum value for $D_n$.

10. The method of claim 9 wherein the step of determining a target removal rate profile comprises the steps of:

measuring the profile of a surface of a work piece to be planarized;

determining the desired profile of the planarized work piece; and determining the amount and distribution of material that must be removed to achieve the desired profile.

11. The method of claim 9 wherein the step of calculating a difference $D_n$ comprises calculating the standard deviation between $RR_n(x)$ and $RR_t(x)$.

12. The method of claim 9 wherein the step of calculating a revised removal rate profile $RR_2(X)$ comprises the step of increasing the pressure in zone one by about one percent to a pressure $P_2(Z_1)$.

13. The method of claim 12 wherein the step of calculating a revised removal rate profile $RR_3(X)$ comprises the step of decreasing the pressure in zone one by about one percent to a pressure $P_3(Z_1)$.

14. The method of claim 9 further comprising the steps of:

repeating steps f) through l) for the pressure in each of the zones; and setting the pressure in each zone to achieve a minimum difference between $RR_n(x)$ and $RR_t(x)$.

15. The method of claim 9 wherein the step of planarizing a work piece comprises the step of planarizing a work piece by chemical mechanical planarization.

16. The method of claim 9 further comprising the step of repeating steps c) through m) for a plurality of work pieces and wherein for each of the work pieces of the plurality of work pieces the step of planarizing a test work piece comprises the step of planarizing a previous one of the plurality of work pieces.

17. A method for controlling a process on a work piece in a processing apparatus, the processing apparatus comprising a plurality of zones $Z_i$ within each of which a processing parameter $J(Z_i)$ can be controlled to establish a processing parameter profile J(x) as a function of position x on the work piece, the processing apparatus producing a process result Q(x) as a function of the application of J(x) to the work piece, the method comprising the steps of:

processing a test work piece using initial settings $J_i(Z_i)$ of a processing parameter J in each of the plurality of zones i to establish an initial process parameter profile $J_1(x)$ and to achieve an initial process result $Q_1(x)$ as a function of position x on the test work piece;

calculating a revised processing result $Q_f(x)$ as a function of position (x) on a work piece as a result of modifying the processing parameter in at least one of the plurality of zones to establish a processing parameter profile $J_f(x)$ as a function of position (x) on the work piece in accordance with the relationship $Q_f(x)=Q_1(x)*J_f(x)/J_1(x)$; and processing a work piece using the processing apparatus with the process parameter in the plurality of zones set to achieve the process parameter profile $J_f(x)$.

18. The method of claim 17 wherein the step of processing a work piece comprises the step of planarizing the work piece in a chemical mechanical planarization operation.

19. The method of claim 17 wherein the step of processing a work piece comprises the step of depositing a film on the work piece in a multi-zonal deposition apparatus.

20. The method of claim 19 wherein the step of depositing a film comprises the step of electrodepositing a metal on the work piece in an electrodeposition apparatus comprising a multi-zonal deposition cathode.

21. The method of claim 19 wherein the step of comparing comprises the step of calculating the standard deviation between $Q_n(x)$ and $Q_t(x)$.

22. The method of claim 17 further comprising the step of determining a target process result $Q_t(x)$.

23. The method of claim 22, wherein the step of modifying the processing parameter comprises the steps of:

sequentially calculating a plurality of processing results $Q_n(x)$ to be obtained by a sequence of process parameter changes in each of the plurality of zones, each of the plurality of processing results calculated by $Q_n(x)=Q_{n-1}(x)*J_n(x)/J_{n-1}(x)$ where (n) denotes the iteration being calculated for a processing parameter profile $J_n(x)$ and (n−1) denotes a previous iteration having the least difference between the process result for that iteration and $Q_t(x)$; and comparing each $Q_n(x)$ to $Q_t(x)$ and setting the processing parameters in each of the plurality of zones to achieve a minimum difference between $Q_n(x)$ and $Q_t(x)$.

* * * * *